US007222646B2

(12) United States Patent
Gupta

(10) Patent No.: US 7,222,646 B2
(45) Date of Patent: May 29, 2007

(54) PISTON FOR DISPENSING DEVICE, DISPENSING DEVICE, PRODUCT CONTAINING DISPENSING DEVICE, METHOD OF FILLING, AND METHOD OF DISPENSING

(76) Inventor: Pradeep Yohanne Gupta, 720 Our Lane Cir., Houston, TX (US) 77024

( * ) Notice: Subject to any disclaimer, the term of this patent is extended or adjusted under 35 U.S.C. 154(b) by 315 days.

(21) Appl. No.: 10/238,209

(22) Filed: Sep. 10, 2002

(65) Prior Publication Data

US 2004/0016777 A1 Jan. 29, 2004

Related U.S. Application Data

(62) Division of application No. 09/912,052, filed on Jul. 23, 2001.

(51) Int. Cl.
*B65B 1/04* (2006.01)
*B65B 7/00* (2006.01)

(52) U.S. Cl. ..... 141/2; 141/20; 141/27; 53/470

(58) Field of Classification Search ..... 141/2, 141/3, 18, 20, 25, 27, 63, 64, 67, 83, 94, 141/95, 100, 311 R; 53/403, 467–470
See application file for complete search history.

(56) References Cited

U.S. PATENT DOCUMENTS 4,685,597 A * 8/1987 Hirao et al. ..... 222/389
4,877,156 A * 10/1989 Clanet et al. ..... 222/386.5

* cited by examiner

*Primary Examiner*—Timothy L. Maust
(74) *Attorney, Agent, or Firm*—Gilbreth Roebuck; J. M. (Mark) Gilbreth; Mary A. Gilbreth

(57) ABSTRACT

A piston for a pressurized container (i.e., "aerosol can"), the piston including a body having circumferential fins, with the fins being of uniform thickness, decreasing thickness radially away from the body, or varying thickness circumferentially. Further disclosed are container precursors and containers incorporating such a piston, and methods of filling and dispensing from such containers.

14 Claims, 9 Drawing Sheets

PISTON FOR DISPENSING DEVICE, DISPENSING DEVICE, PRODUCT CONTAINING DISPENSING DEVICE, METHOD OF FILLING, AND METHOD OF DISPENSING

RELATED APPLICATION DATA

This application is a Divisional application of copending parent U.S. patent application Ser. No. 09/912,052, filed Jul. 23, 2001, which parent application is also incorporated herein by reference.

BACKGROUND OF THE INVENTION

1. Field of the Invention

The present invention relates to pistons, to precursors for making containers, to containers, to product-containing containers, to methods of making such pistons, precursors, containers and product containing containers, to methods of dispensing, and to methods of filling containers. In another aspect, the present invention relates to pistons for pressure operated dispensing containers, to pressure operated dispensing containers utilizing a piston longitudinally slidable within the container, product-containing containers, to methods of dispensing, and to methods of filling. In even another aspect, the present invention relates to pistons for pressure operated dispensing containers, to pressure operated dispensing containers utilizing a piston longitudinally slidable within the container, product-containing containers, to methods of dispensing, and to methods of filling, all of which provide improved resistance to "leak through" of product past the piston.

2. Description of the Related Art

Pressure operated dispensing containers which utilize a piston longitudinally slidable within the container are well known in the art. These types of containers are used to dispense any number of products, for example many consumer products such as shaving gels.

Such a pressurized container is generally cylindrically shaped, and includes a movable piston disposed therein, which divides the container reservoir into two chambers, i.e., the chamber above the piston or the "upper chamber" wherein the product composition resides, and the chamber below the piston or the "lower chamber" wherein the compressed fluid is injected or pressure filled. Said compressed fluid is at a pressure higher than ambient and higher than that of the product in the upper chamber. A dispensing valve is positioned to be in liquid communication with the product containing composition compartment, to allow for dispensing of the product composition for use.

The piston is roughly in the form of an inverted cup, with a curved surface designed to closely match the inside-top of the container such that in its penultimate position at the top of the container, the piston will have forced and dispensed essentially all of the product composition in the upper chamber through the dispensing valve. This helps in minimizing product composition left unused or undeliverable inside the container. In addition, the piston has an upper and an annular skirt or sidewall which extends down from the upper surface. The upper surface acts as a barrier to separate the product from the gas. The annular sidewall of the piston stabilizes and positions the piston in the container and provides a surface which rides on the inner wall of the container.

While the exact details of loading may vary from industry-to-industry and product-by-product, the following is a general description. The product to be dispensed is loaded into the upper chamber of the container under pressure. The loading is a three stage operation, with each stage occurring at a different index position on the loading machine. During the first stage, known as the fill stage the product is introduced into the can above the top of the piston. During the second stage, known as the pressure stage a pressure differential is created above and below the piston to force some of the product down around the periphery of the piston between the piston sidewall and the container. During the third stage, known as the pushup stage, the piston is pushed toward the top of the container. This pushup stage also causes product to seep down around the periphery of the piston. After the loading of the product into the upper chamber is completed, propellant is loaded into the lower chamber under pressure. In use, when the valve at the top of the container is opened, the propellant pushes the piston toward the top of the container through the valve.

In operation of, for example, a pressurized container of shaving gel, a user will activate the product dispensing valve, whereupon the pressurized gas will urge the piston to move against the product, thus urging the product out of the dispensing valve.

One major problem with these type of pressurized containers is that the product may slip past the piston into the pressurized gas compartment (sometimes referred to as "leak through"). Specifically, prior art pistons have not been entirely satisfactory during both the loading of the pressurized container and during the dispensing of the product therefrom.

The following are some of the numerous patents directed to pistons for aerosol containers.

U.S. Pat. No. 3,132,570, issued May 12, 1964, to H. T. Hoffman, Jr., et al, discloses a piston construction for an Aerosol Container.

U.S. Pat. No. 3,245,591, issued Apr. 12, 1966, to R. H. P. Kneusel, et al, discloses a dispensing piston can.

U.S. Pat. No. 3,381,863, issued May 7, 1968, to E. J. Towns, discloses a piston for use in pressurized dispensing containers and more particularly to a piston for use in pressurized dispensing containers in which the propellant is separated from the goods to be dispensed. The piston includes a number of flanges, which the patent teaches are of generally diminishing thickness from the flange's portion of greatest diameter to its portion of least diameter to avoid "wrinkling" when the piston is engaged in a can. Disposed on the end of the flanges are thin skirts which more easily adopt the configuration of the container's interior surface than the thicker portion of the annular flanges. The outside diameter of the flange as measured on the piston prior to insertion in the can is greater than the inside diameter of the can.

U.S. Pat. No. 3,407,974, issued Oct. 29, 1968, to L. J. Chmielowiec, discloses a dispensing container having piston-bag structure.

U.S. Pat. No. 3,433,134, issued Mar. 18, 1969, to P. B. Vellekoop, discloses a piston for use in an aerosol can having an outer tubular container provided with a propellant gas therein. The piston has a cylinder provided with a centrally concave wall together with a centrally disposed disk. A plurality of supports join the cylinder and the disk and are equally spaced at an angle of approximately forty-five degrees to each other. The wall supports are arranged in vertically aligned pairs and extend along the disk substantially one-half the radius thereof. The cylinder has upper and lower wiping edges defined by the concave wall and the entire piston assembly may be integrally molded from a synthetic plastic material.

U.S. Pat. No. 3,901,416, issued Aug. 26, 1975, to Robert S. Schultz, discloses a piston-operated pressurized container adapted for top-loading with viscous foods or other viscous products, the body of the piston having a substantially smaller diameter than the diameter of the container. The outer periphery of the piston is provided with a resilient flange member that maintains a light sealing pressure on the interior surfaces of the container, allowing the piston to move upwardly within the container. The inventive method provides enhanced assurance against product leakage and against propellant-contamination of product, prior to selective product discharge as desired.

U.S. Pat. No. 3,987,941, issued Oct. 26, 1976, to Alfred V. Blessing, discloses a container for cooked liquid food substances in which there is provided a follower lid or upper cover capable of following the level of the liquid as the food substance is removed from the container. The invention includes a particular construction of lid and seal that allows for free upward and downward movement of the lid in contact with the liquid as the liquid level changes. In this manner, the liquid is not in contact with air which would cause its contamination and loss of flavor.

U.S. Pat. No. 4,023,717, issued May 17, 1977, to Schultz, discloses a pressurized container for viscous foods or other viscous products in which the body of the piston includes an axially intermediate flexible circumferential band which lightly contacts or is expandable in the presence of loading pressure exerted by propellant gas. The band thus develops light sealing contact with the interior wall surface of the container, and such contact effectively isolates unexpelled product from the gas-pressure side of the piston, regardless of the extent to which product has been expelled.

U.S. Pat. No. 4,106,674, issued Aug. 15, 1978 to Schultz, discloses a pressurized container for viscous foods or other viscous products in which the body of the piston includes, adjacent to the head end, a flexible circumferential band which lightly contacts or is expandable in the presence of loading pressure exerted by propellant gas. The band thus develops light sealing contact with the interior wall surface of the container, and such contact effectively isolates unexpelled product from the gas-pressure side of the piston, regardless of the extent to which product has been expelled. The piston further includes a circumferentially continuous tail structure which is connected to and axially spaced from the expandable band and which serves to stabilize the piston against malfunction in the course of its single product-expelling stroke.

U.S. Pat. No. 4,234,108, issued Nov. 18, 1980, to Diamond, discloses a piston for an aerosol container, particularly adapted for insertion through the top of the container. The piston includes an annular, cylindrical collar near its top end and a conical outwardly flaring flange atop the cylindrical collar, with the flange flaring wider toward the top of the container, whereby the flange scrapes the container interior as it moves up. The cylindrical collar is more flexible than the conical flange to ease insertion of the piston and for more effective piston sealing despite the piston cocking in the container. An anti-cocking ring is provided on the piston.

U.S. Pat. No. 4,323,177, issued Apr. 6, 1982 to Nielsen, discloses an ejection piston for use in cylindrical dispensing containers or packages of the type containing viscous or plastic masses such as sealing compounds and adhesives. The piston assembly comprises a piston part having a peripheral skirt as well as an arched piston top, and a separate piston actuating member arched in a direction opposite to the piston top. An ejection pressure is applied to the actuating member and transmitted to the piston top whereby the effective diameter of the piston top is slightly increased. An annular sealing sleeve for receiving the piston skirt and the adjacent free end of the cylindrical container during storage may be formed integrally with the piston actuating member.

U.S. Pat. No 4,703,875, issued Nov. 3, 1987 to Malek, discloses an injection-molded piston for an aerosol container with a face portion for contacting and exerting pressure on material to be dispensed, and a thin, flexible skirt depending axially from and circumscribing the face portion for forming an effective seal against the inside wall of the container. The outer wall of the skirt is continuous, while the circumference of the inner wall has alternating areas of constant thickness along said areas and areas of minimum thickness, the curved portions forming with the outer wall a plurality of sections, the thickness and circumferential extent of each of which decrease axially along the skirt toward its distal end. The piston includes a depending extension on the skirt which aids sealing.

U.S. Pat. No. 4,913,323, issued Apr. 3, 1990, to Scheindel, discloses a piston that is longitudinally slidable within a pressurized container to dispense materials from the container. The piston has a generally annular sidewall and a traverse barrier wall at one end of the sidewall and integral therewith to define a cup-shaped closure open at one end. An annular step is provided on the sidewall which divides the sidewall into two segments, an upper segment and a lower segment. The annular step is below and spaced from the barrier wall. The upper segment has a diameter smaller than the diameter of the lower segment and the clearance between the upper segment and the interior of the container is substantially greater than the clearance between the lower segment and the interior of the container.

U.S. Pat. No. 5,127,556, issued Jul. 7, 1992, to Sporri, discloses an aerosol can piston and container system, employing an aerosol can with a sidewall which is necked in at the bottom and a low mass piston with recessed, depending legs. The piston has a lower skirt portion, the outermost diameter of which is slightly smaller than the diameter of the inner wall of the can above the necked-in portion. The legs depending from the piston have an effective outer diameter somewhat less than the inside diameter of the lower necked-in portion of the can sidewall and depend sufficiently downward to sit on the can bottom countersink while maintaining the skirt of the piston at a level just above the level at which the can sidewall necks inwardly. The legs thus stabilize the piston and prevent tipping and canting. In an alternative embodiment the piston also includes a plurality of vertical columns protruding from its sidewall to further stabilize the piston.

However, in spite of the above advancements, there still exists a need in the art for pistons, for container precursors, for containers, for product-containing containers, for methods of dispensing, for methods of filling containers, and for methods of making such pistons, container precursors, and containers.

There exists another need in the art for pistons, for container precursors, for containers, for product-containing containers, for methods of dispensing, for methods of filling containers, and for methods of making such pistons, container precursors, and containers, which reduce the "leak through" problem as compared to the prior art.

There exists even another need in the art for pistons, for containers, for container precursors, for product-containing containers, for methods of dispensing, and for methods of filling containers, and for methods of making such pistons, container precursors, and containers, which do not suffer from the disadvantages of the prior art apparatus and methods.

These and other needs in the art will become apparent to those of skill in the art upon review of this specification, including its drawings and claims.

SUMMARY OF THE INVENTION

It is an object of the present invention to provide for pistons, container precursors, containers, for product-containing containers, for methods of dispensing, for methods of filling containers, and for methods of making such pistons, container precursors, and containers.

It is another object of the present invention to provide for pistons, for container precursors, for containers, for product-containing containers, for methods of dispensing, for methods of filling containers, and for methods of making such pistons, container precursors, and containers, which reduce the "leak through" problem as compared to the prior art.

It is even another object of the present invention to provide for pistons, for containers, for container precursors, for product-containing containers, for methods of dispensing, for methods of filling containers, and for methods of making such pistons, container precursors, and containers, which do not suffer from the disadvantages of the prior art apparatus and methods.

These and other objects of the present invention will become apparent to those of skill in the art upon review of this specification, including its drawings and claims.

According to one embodiment of the present invention, there is provided a piston for use in a pressurized piston operated product dispensing container, the piston comprising a body and, at least one fin circumferentially positioned around the body, wherein the fin is of uniform thickness.

According to another embodiment of the present invention, there is provided a piston for use in a pressurized piston operated product dispensing container, the piston comprising a body and, at least one fin circumferentially positioned around the body, wherein the thickness of the fin varies circumferentially.

According to even another embodiment of the present invention, there is provided a piston for use in a pressurized piston operated product dispensing container, the piston comprising a body and, at least one fin circumferentially positioned around the body, wherein the thickness of the fin decreases radially away from the body.

According to still another embodiment of the present invention, there is provided a container having a hollow cylindrical body defining a reservoir, sealed on the ends by a bottom wall and a valved cap, with any of the pistons as described above, positioned within and dividing the reservoir in upper and lower chambers.

According to yet another embodiment of the present invention, there is provided a container having a hollow cylindrical body defining a reservoir, with the ends sealed by bottom wall and a valved cap. Positioned within and dividing the reservoir in upper and lower chambers, is a piston having at least one circumferential fin. When the fin is in a first unactivated position, it does not radially extend to the hollow cylindrical body, and when the fin is in a second activated position, it radially extends to and contacts the hollow cylindrical body.

According to even still another embodiment of the present invention, there is provided a container precurser useful for forming into a container by sealing the ends thereof. This container precurser comprises a hollow cylindrical body having positioned therein any of the above described pistons.

According to even yet another embodiment of the present invention, there is provided a method of filling the above described containers. The method includes a first step of providing propellant to the lower chamber at a propellant fill rate, and a second step of providing product to the upper chamber at a product fill rate. In a further embodiment these steps are carried out simultaneously. An even further embodiment, includes monitoring the pressure of the upper chamber and the lower pressure and adjusting at least one of the propellant fill rate or product fill rate.

According to still even another embodiment of the present invention, there is provided a method of dispensing from any of the above described container having product in the upper chamber and propellant in the lower chamber. The method includes operating the valved cap to dispense product.

According to still yet another embodiment of the present invention, there is provided, a method of filling a container comprising a hollow cylindrical body defining a reservoir and sealed by a bottom wall and a valved cap, and having a piston positioned within and dividing the reservoir into upper and lower chambers. The method includes simultaneously providing propellant to the lower chamber at a first fill rate, while providing product to the upper chamber at a second fill rate. Optionally, the method further includes monitoring the pressure of the lower chamber and the upper chamber and varying the first and second fill rates to maintain the pressure of the lower chamber and the pressure of the second chamber within a desired differential pressure range.

For the above embodiments which include a container, non-limiting examples of products which might be residing in upper chamber include oil-in-water emulsions, water-in-oil emulsions, polymeric gels, foams, surfactant mixtures, dispersions, colloidal dispersions, suspensions, polymer solutions, polymer melts, detergents, laundry and cleaning products, adhesives, lubricating oils and greases, paints, chemicals, any type of flowable food product, such as condiments, mayonnaise, ketchup, mustard, sauces, pastes, syrup, cheeses, spreads, jams, jellies, butter/margarine, oil sprays, and the like, and any type of health, beauty and personal care products such as cosmetics, lotions, creams, gels, sprays, mousses, shampoos and conditioners, wound care and the like.

DETAILED DESCRIPTION OF THE INVENTION

The present invention will now be described by reference to the figures.

Apparatus

Figure 1A:
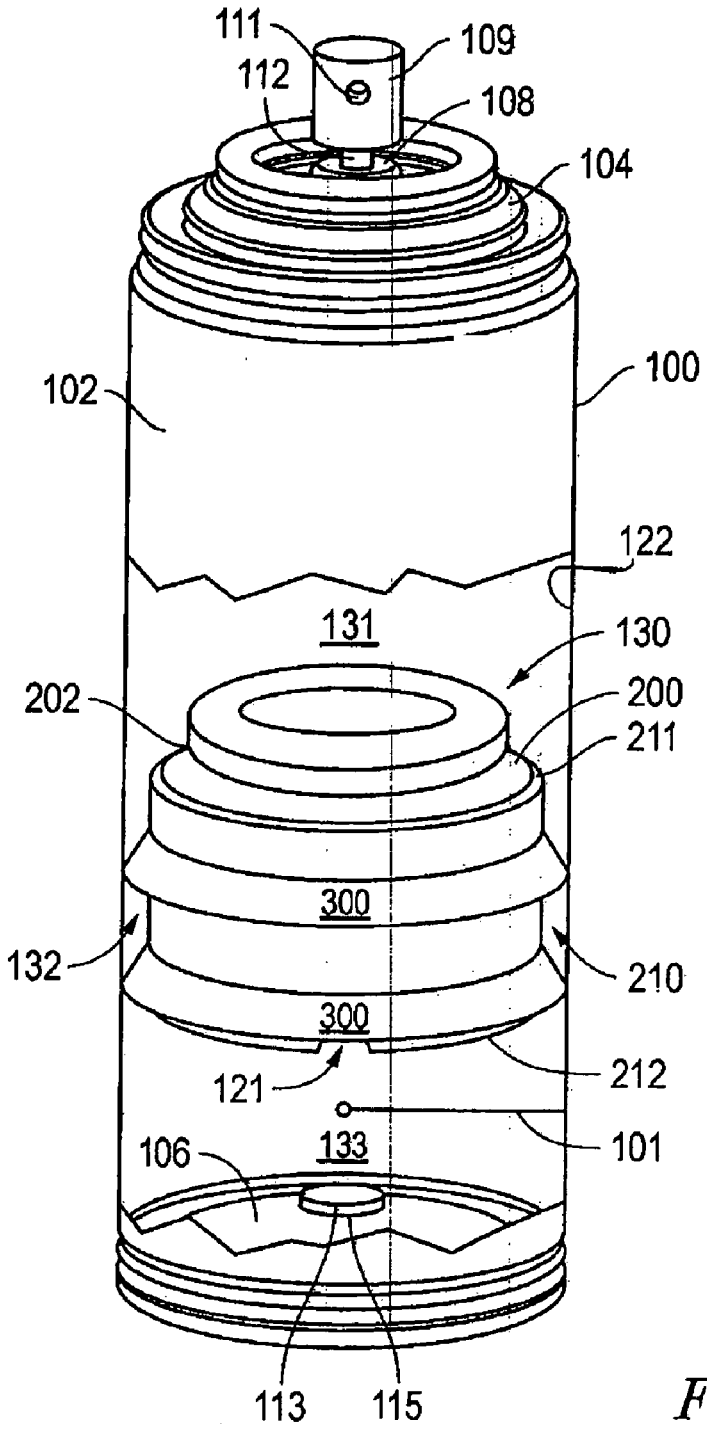
FIGS. 1A and 1B are, respectively, a side elevation view, partially broken away, and an isometric view, partially broken away, of pressurized container 100, further showing piston 200 of the present invention.
Figure 1B:
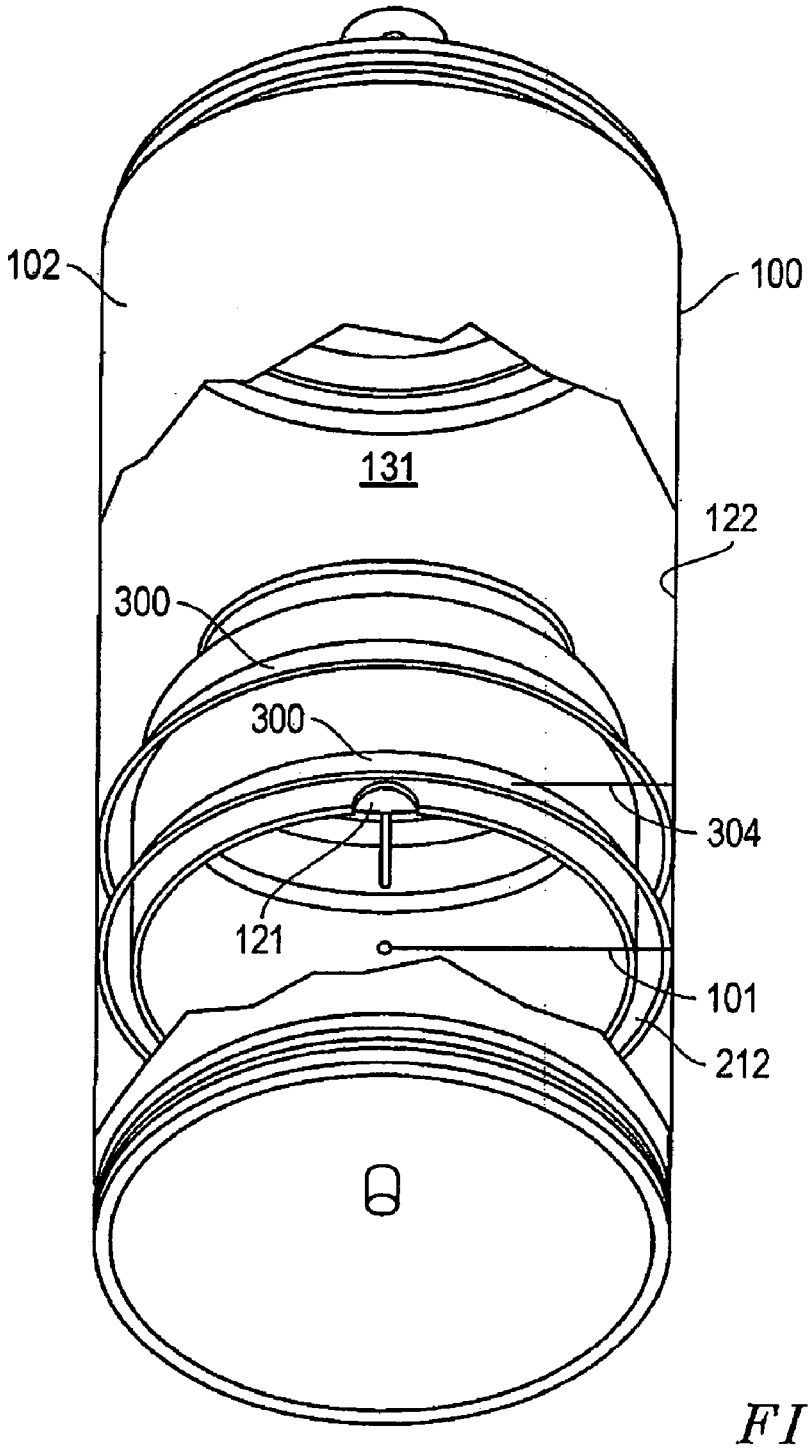

Referring first to FIGS. 1A and 1B, there are shown respectively, a side elevation view and an isometric view, both partially broken away, of pressurized container 100 similar to many of the containers commercially available for dispensing materials, with piston 200 of the present invention positioned therein.

In the practice of the present invention, it should be understood that any suitable pressurized dispensing container may be utilized, provided the container is operable with the piston of the present invention. Thus, while the exact details of pressurized containers suitable for use in the practice of the present invention may vary, container 100 is an example of a suitable container, and includes a generally cylindrically shaped body 102 defining a reservoir 130, which body 102 may or may not be seamless, includes a cap 104 which seals the dispensing end, and includes a bottom wall 106 for sealing the bottom, all of which are sealed together by any means and methods known to those of skill in the art so that container 100 is suitable for handling contents under pressure.

Bottom wall 106 defines a centrally positioned opening 115 which is sealed by plug or check valve 113.

Cap 104 defines a centrally positioned opening 108 for receiving valve assembly 112 in liquid communication with the contents of container 100. Valve assembly 112 and dispensing nozzle 109 may be selected from among any of nozzles well known in the art, with nozzle 109 connected to and in liquid communication with valve assembly 112. As is well known to anyone who has ever operated a pressurized product container, depression of dispensing nozzle 109 allows the dispensing of the contents of container 100 through orifice 111.

In one method of the present invention, positioning piston 200 in cylindrical body 102 forms a container precurser, that in a further method of sealing each end can be formed into a container 100.

Figure 2:
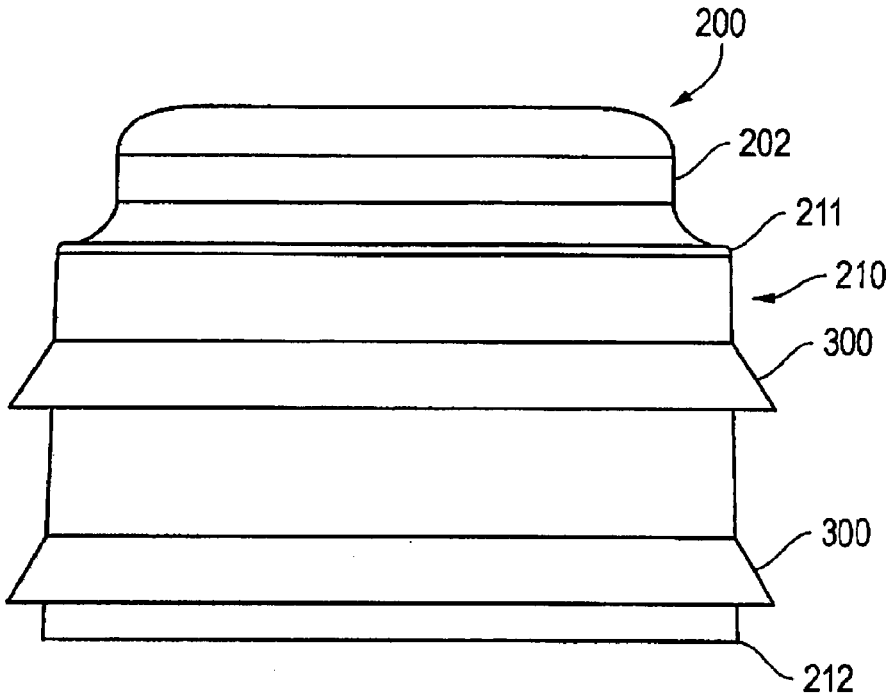
FIGS. 2-5, are side, bottom, isometric, and top views of piston 200 of the present invention.
Figure 4:
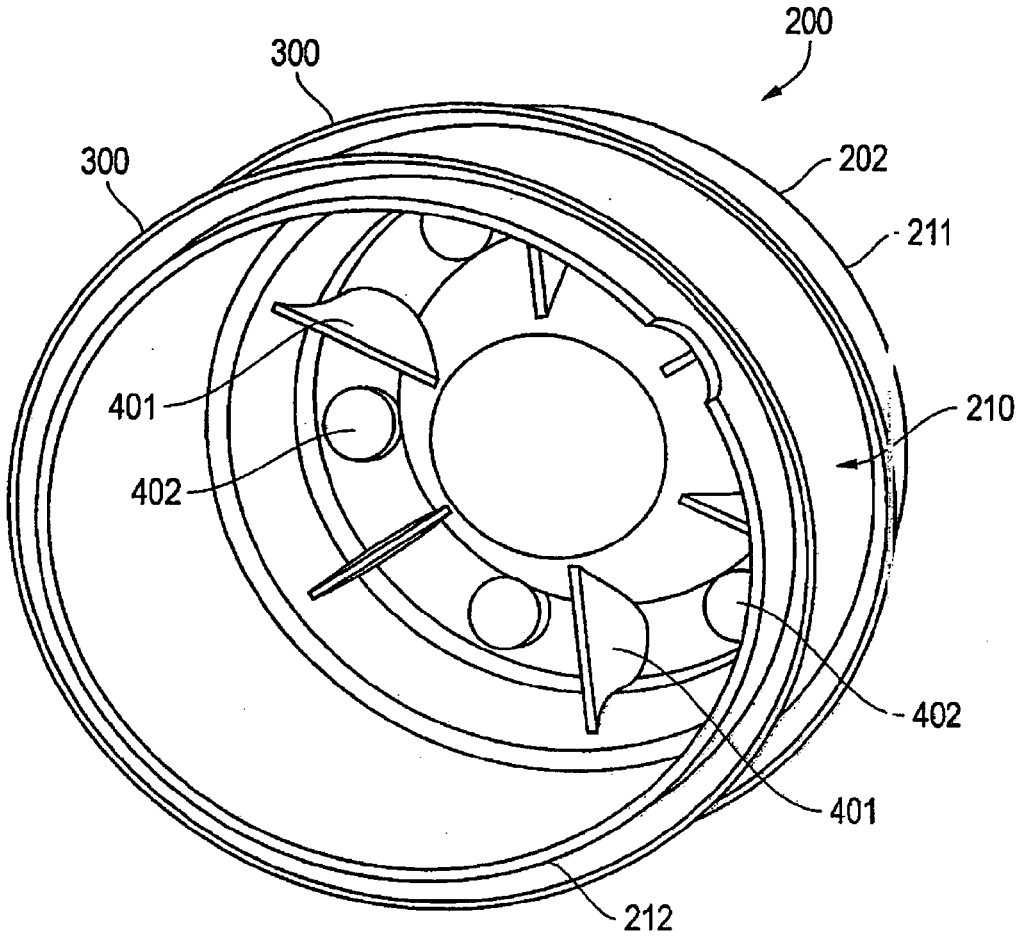
Figure 5:
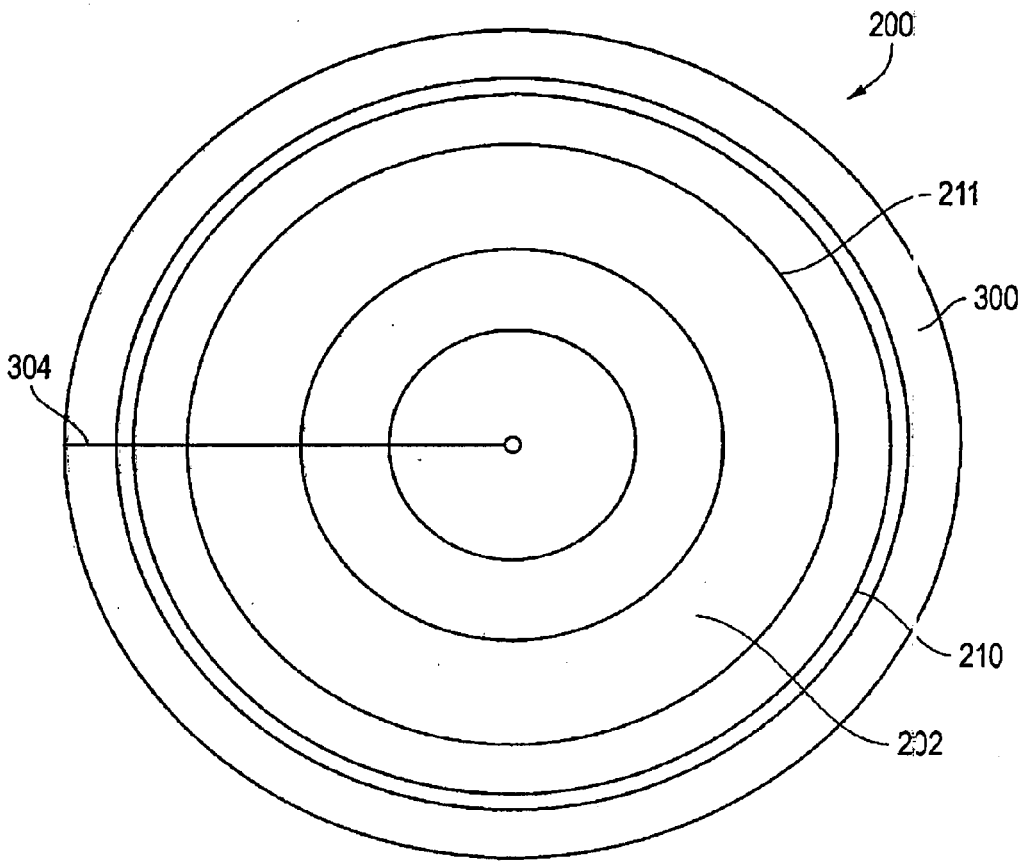
Figure 6:
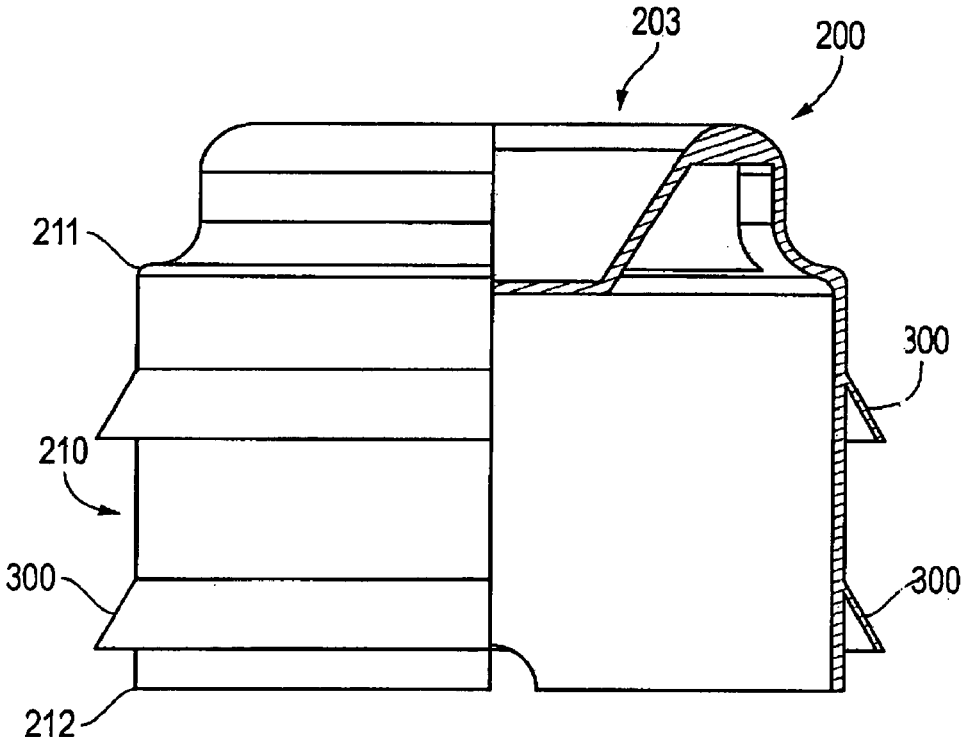
FIG. 6 is a partial break away view, and FIG. 8 an alternative embodiment of piston 200 of FIG. 2 broken away at section A-A.

Referring additionally to FIGS. 2-6, there are shown in FIGS. 2-5, side, bottom, isometric, and top views of piston 200, and in FIG. 6 a partial break away view of piston 200 of FIG. 2 at section A-A.

The main body of piston 200 includes an upper portion 202 which is generally shaped to be received into the inner top surface of container 100 so that product dispersion is not limited by cap 104 prematurely restricting the upper extent of travel of piston 200. Upper portion 202 may also include a concave portion 203 to avoid impinging on any portion of valve system 112 that extends into the top portion of container 100. Preferably, upper portion 202 is shaped not only to be received into, but also to conform to the inner top surface of container 100.

The main body of piston 200 also includes a bottom portion 210 depending from said Upper portion 202 for supporting one or more sealing fins 300.

Preferably, and in the embodiment as shown, bottom portion 210 preferably has a larger diameter than upper portion 202, although upper portion 202 may have a larger or equal diameter.

Figure 3:
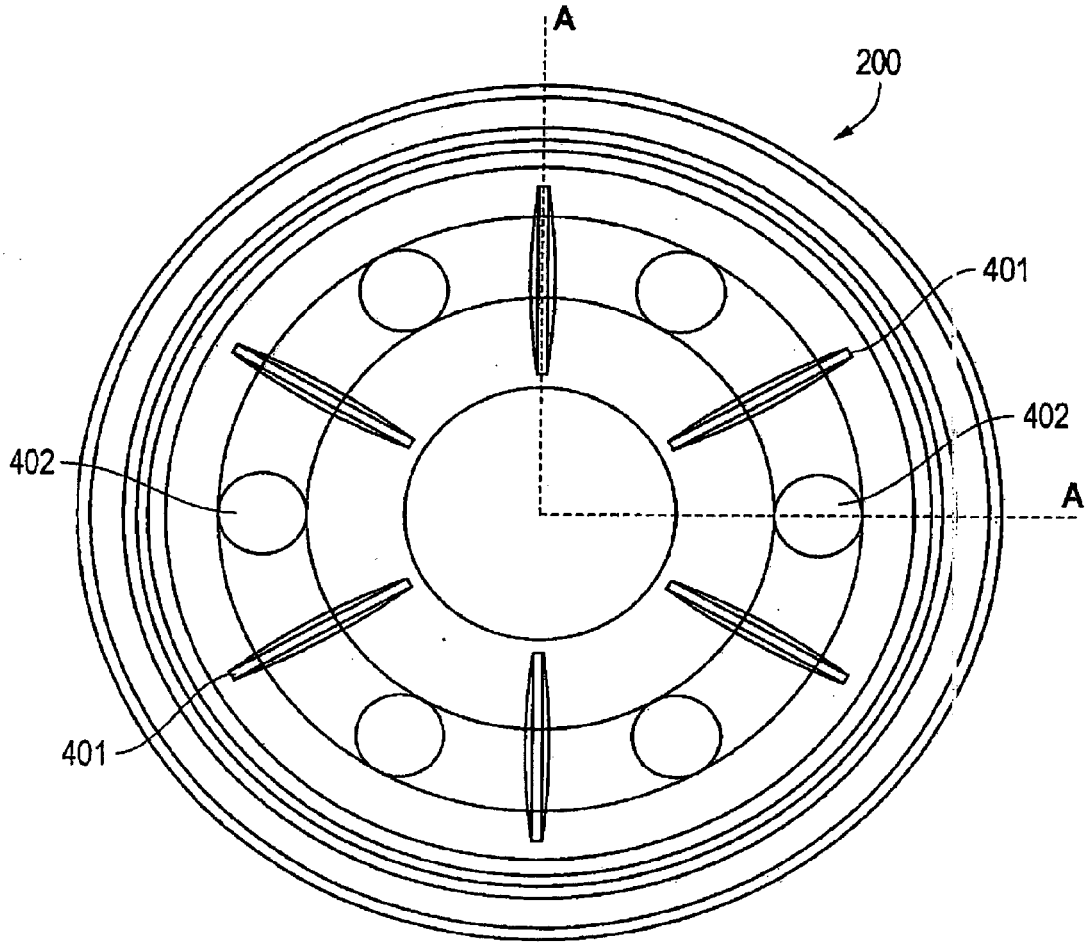

For convenience, and in the embodiment as shown in FIG. 3 and FIG. 5, upper portion 202 and bottom portion 210 both have circular shaped side-to-side cross sections, although is should be understood that any suitable regular or irregular geometric shape, or n-sided shape (of equal or unequal sides) may be used, as sealing is accomplished by circumferential fins 300.

The present invention is not to be limited to any particular geometric shape for top portion 202 and bottom portion 210, provided that piston 200 is movable within container 100. In the practice of the present invention, top portion 202 and bottom portion 210 may comprise any suitable regular or irregular geometric shape, non-limiting examples include for example, cylindrical, conical, cube, or pyramid-shaped. Preferably, top portion 202 and bottom portion 210 are cylindrical.

When piston 200 is positioned inside container 100, with fins 300 abutting the inner wall 122 of container 100, one or more portions or all of top portion 202 and bottom portion 210 may also abut the inner wall 122 of container 100, however, it is preferred that none of top portion 202 or bottom portion 210 abut the inner wall 122.

In the practice of the present invention, piston 200 includes at least one, and preferably at least two, even more preferably at least three sealing fins 300, positioned supported by and circumferentially extending around piston 200 in a manner suitable for forming a seal against the inner wall of container 100 once fins 300 are activated in response to pressure from the propellant.

Sealing fins 300 are of suitable resiliency and thickness that upon being activated in response to pressure from the propellant, will extend toward and sealingly engage the inner wall 122 of container 100.

Generally, sealing fins 300 may be of uniform thickness throughout or the thickness may vary circumferentially or radially. While prior art sealing fins are sometimes taught to increase in thickness in the radial direction away from the piston body, the inventor notes that such would be difficult to manufacture in conventional molding processes. Sealing fins 300 may vary in thickness circumferentially, that is, along a path taken circumferentially around the piston. Sealing fins 300 may decrease in thickness radially away from the body of piston 300, that is, along a path radially away from the body. Preferably, sealing fins 300 are of uniform thickness both radially and circumferentially, more preferably decrease in thickness in the radial direction away from piston 200.

Each of sealing fins 300 may have a thickness, or thickness profile that is the same or different than the thickness or thickness profile of other sealing fins 300. As a non-limiting example, a first sealing fin 300 may be of uniform thickness, with sealing fin 300 having a thickness that varies circumferentially.

Sealing fins 300 may be positioned on upper portion 202 and/or lower portion 210, but are preferably supported by lower portion 210 as shown in the figures.

When piston 200 is positioned in container 100 and activated by propellant pressure so that fins 300 sealingly engage the inner wall 122 of container 100, it will divide reservoir 130 of container 100 into an upper product containing chamber 131 and a lower propellant containing chamber 133. Provided that there are at least two fins 300, one or more buffer chambers 132 bounded above and below by fins 300 will also be created. It should be observed that the number of buffer chambers 132 is equal to the number of sealing fins 300 less 1. These one or more buffer chambers 132 provide an extra measure of protection against any leakage of propellant into the product, and visa versa. Additionally, these one or more buffer chambers 132 also allow piston 200 to traverse small dents, surface irregularities, imperfections, or other anomalies, with a measure of protection against leakage of propellant into the product, and visa versa.

Sealing fins 300 are of suitable length that when piston 200 is positioned in container 100, and piston 200 is activated by propellant pressure as shown in FIGS. 1A and 1B, fins 300 will extend toward and sealingly engage the inner wall 122 of container 100. Thus, upon activation, the sealing fins 300 must have an outer diameter 304 in the activated state that, if extended unobstructed by inner wall 122, would be greater than the inside diameter 101 of container 100, so that sealing fins 300 can sealingly engage inner wall 122. However, when sealing fins 300 are not activated, it is not necessary that the outside diameter of sealing fins 300 have a diameter 304, if extended unobstructed, that is greater than the inside diameter 101 of container 100. Thus, generally in the unactivated state, sealing fins 300 have a diameter 304, that if unobstructed, would be greater than the inner diameter 101 of container 100, preferably have a diameter 304 less than or equal to the inner diameter 101 of container 100, and more preferably have a diameter 304 less than the inner diameter 101 of container 100.

Generally, sealing fins 300, will form an inclusive angle (the smaller angle of the two formed), with piston 200 in the range of greater than 0 to about 90, preferably in the range of about 5 to about 90 degrees, more preferably in the range of about 15 to about 75 degrees. In the embodiment shown in FIGS. 1A and 1B, sealing fins 300 will are pointed or angled generally downward toward the bottom 106 of container 100, that is, with the inclusive angle formed closer to and angled toward the direction of the pressurized fluid. Of course, it should be understood that sealing fins 300 could less preferably be pointed generally upward toward cap 104, that is, with the inclusive angle formed closer to and angled toward the direction of the upper chamber 131. However, in an alternative embodiment, sealing fins 300 closest to the product chamber 131 may be pointed or angled generally toward the chamber 131, and sealing fin 300 closest to the pressurized fluid chamber 133 may be pointed or angled generally toward the pressurized chamber 133.

To provide greater structural integrity, piston 200 may be provided with any number of design features, such as support members 401 and 402 shown in FIGS. 3 and 4.

A pressure passage 121 is provided to allow container 100 to be pressure tested while piston 200 is positioned therein.

Piston 200 may be made of any suitable material compatible with container 100, and otherwise compatible with the propellant utilized and the product to be delivered. Of course, piston 200 may be provided a suitable surface composition and/or texture that is compatible with container 100, the propellant utilized and the product to be delivered. Non-limiting examples of suitable materials include metals, thermoplastic or thermoset polymers, naturally occurring materials such as wood or natural resins, composite materials, ceramics, or any combinations thereof. Preferably, piston 200 comprises a polymer, more preferably a thermoplastic. Non-limiting examples of a suitable polymers include polyolefins, including homopolymers and copolymers of $C_1$ to $C_{10}$ alphaolefins, examples of which include but are not limited to polyethylene or polypropylene.

Sealing fins 300 may be made of the same or different materials of construction as those of piston 200 provided that the material has suitable resiliency and surface friction properties such that under the normal operating conditions of container 100, fins 300 will suitably engage inner wall 122 to form a suitable seal.

While all of sealing fin 300 may comprise the same material, optionally, sealing fin 300 may utilize different materials for different parts of fin 300.

For example, one type of material may be utilized for the main body of sealing fin 300 to provide a certain resiliency for engaging inner wall 122.

As another example, another type of material may be utilized for those contact surfaces of sealing fin 300 that are in contact with inner wall 122. These contact surface materials require friction properties such that piston 200 is suitably slidable within container 100 and suitable sealing occurs.

Non-limiting examples of materials suitable for use for all of, or any part of sealing fin 300, including the contact surfaces, include metals, thermoplastic or thermoset polymers, naturally occurring materials such as wood or natural resins, composite materials, ceramics, or any combinations thereof. In the embodiment tested in the Example, all of piston 200, including the contact surfaces, was made from low density polyethylene ("LDPE").

Of course, it may also be desirable to "pair" the materials of the contact surfaces with those of inner surface 122. Preferred materials of construction for the fin contact surfaces and/or inner wall 122, include any friction reducing or low friction materials, non-limiting examples of which include polytetrafluoroethylene (a commercially available example is sold under the tradename TEFLON), any type of fullerene, that is any substituted or unsubstituted $C_{60}$ compound, and graphites. These materials may be incorporated into fin 300 and/or inner surface 122, or may form a layer or coating thereon.

Piston 200 may be made by any process utilizing any suitable apparatus as known to those in the manufacturing art, with the method and apparatus being suitable for the material utilized. For polymeric materials, any of the known methods of forming, including blow molding, vacuum forming, stamp molding, extrusion, pultrusion, rota-molding, injection molding, and the like, may be utilized.

A container precursor, from which a container may be formed, is made by insertion of the piston of the present invention into a cylindrical body, such as for example cylindrical body 102. This container precursor may be further provided with a cap, such as cap 104, for sealing the dispensing end, and/or a bottom wall, such as bottom wall 106, for sealing the bottom, all of which are sealed together by any means and methods known to those of skill in the art. Of course, valves and plugs may further be provided to construct a pressurized dispensing container.

Methods

One embodiment of the method of the present invention for filling an aerosol container is provided as follows.

First, the container with piston positioned inside, is gravity filled with product composition in the upper chamber to the desired level or weight.

Next, a suitable aerosol valve is securely placed and crimped onto the container.

Next, propellant fluid is injected into the lower chamber, energizing the seals on the piston.

Finally, the container is then "reverse vacuum" treated "through the valve" in another machine to remove any air trapped on the inside top of the container, preventing "spitting" or "sputtering" of the Container when first actuated. At this point, the Container filling process is complete.

A preferred embodiment of the method of the present invention for filling an aerosol container is provided as follows.

First, an aerosol valve is placed on top of an empty piston equipped container, and the valve is suitably vacuum crimped. Vacuum crimping is known to a person of ordinary skill in the art of producing aerosol products, and involves first pulling a vacuum on the container and then securely attaching the aerosol valve to the top opening on the can by mechanically crimping the aerosol valve to the container opening. Vacuum is pulled prior to crimping to ensure that air is removed from inside the Container, which minimizes or prevents oxidation of the product composition. It is most common to pull a vacuum in the 15-22 mm of Hg range, although higher or lower vacuum settings can also be used.

Next, the container is simultaneously "pressure filled" through the aerosol valve on top and "injection filled" with a propellent from the bottom. It is understood that the container will be equipped with a plug (commonly a Nicholson valve, or perhaps any suitable check valve) on the bottom of the container, designed to allow injection of propellant fluid and subsequent sealing of the lower chamber of the container to prevent the high pressure propellant fluid from escaping from the container.

Figure 7:
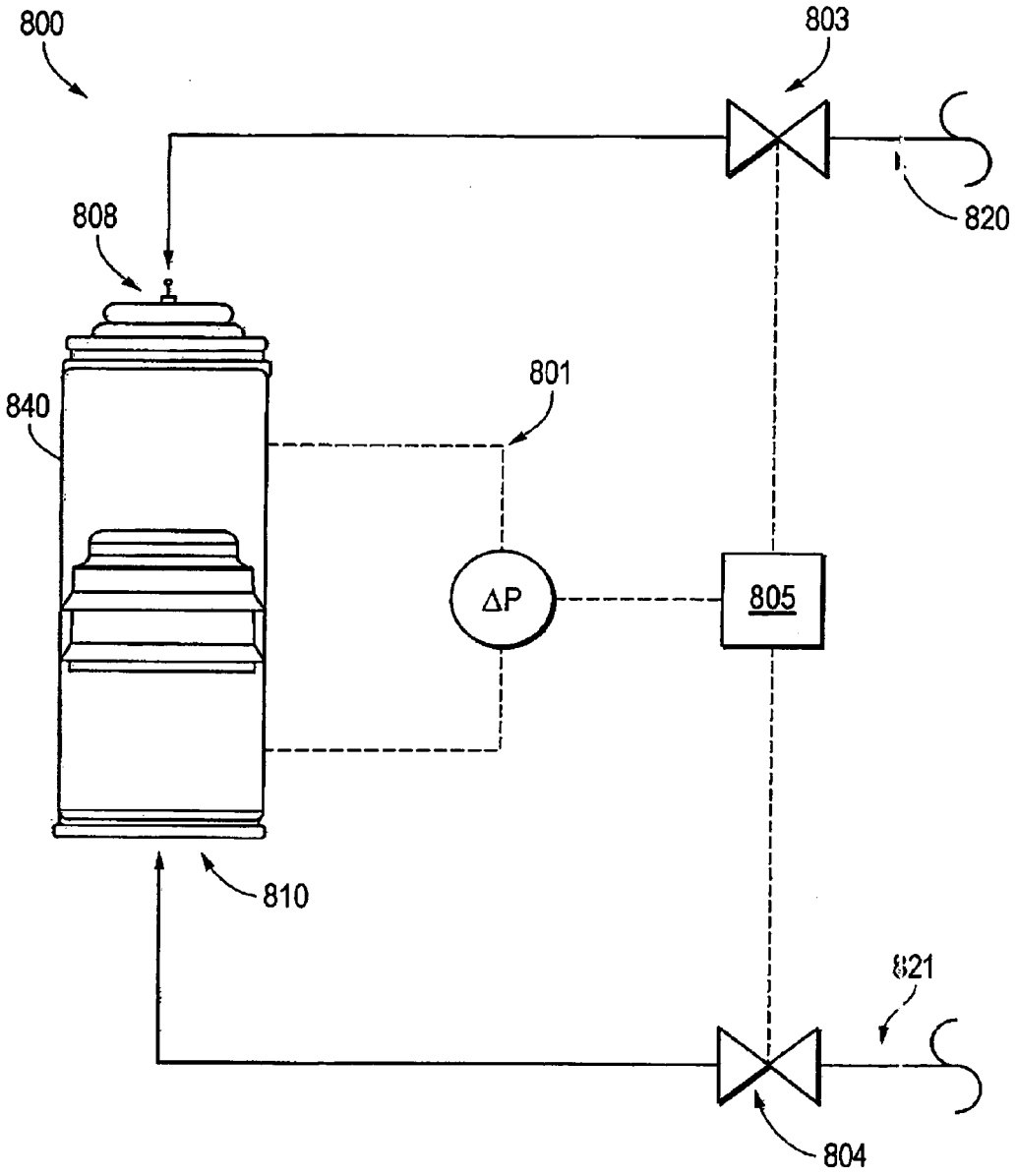
FIG. 7, is a schematic representation of a preferred simultaneous filling method 800 of the present invention, which utilizes a finely calibrated differential pressure monitoring circuit 801 with appropriate control valves 803 and 804 for controlling respectively, product feed line 820 and propellant line 821, and programmable logic controller 805 to allow the setting and dynamic control of any differential pressure between the upper and lower chamber of Can 840.
Figure 8:
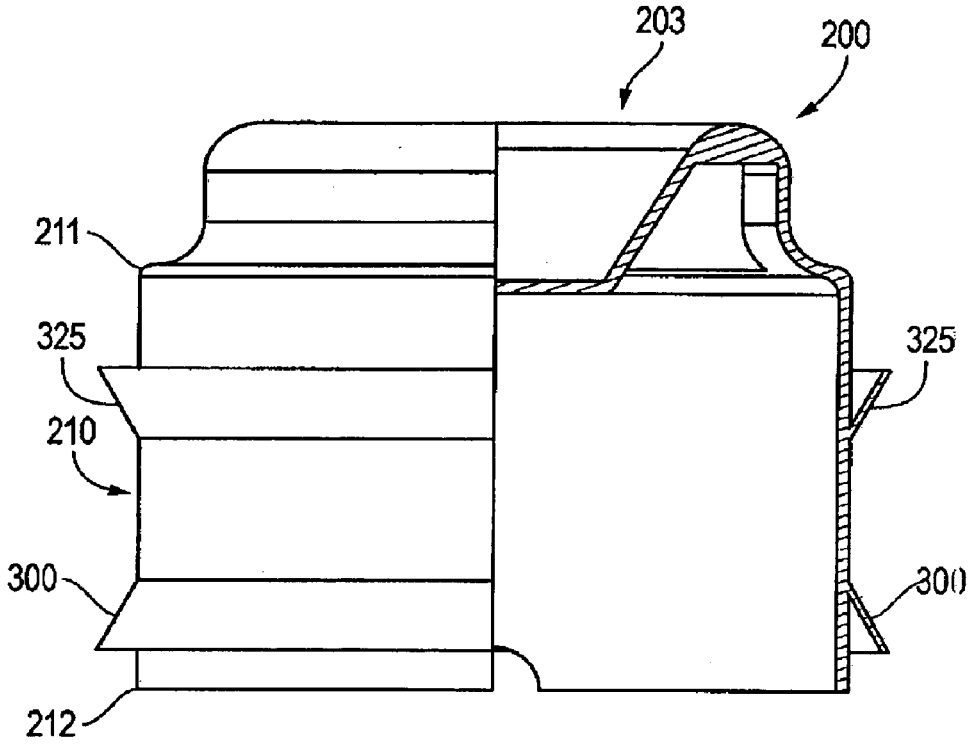

Preferably, this simultaneous filling method is implemented with an automated control scheme, involving pressure monitoring and computer control of the propellant and product fill rates. Of course, any number of suitable automated control schemes could be utilized. Shown in FIG. 7 is one non-limiting example control scheme which utilizes a finely calibrated differential pressure monitoring circuit 801 with appropriate control valves 803 and 804 for controlling respectively, product feed line 820 and propellant line 821, and programmable logic controller 805 to allow the setting and dynamic control of any differential pressure between the upper and lower chamber of container 840. This is done to simultaneously pressure fill the product composition through the aerosol valve 808 while pressurizing the lower chamber with the propellant fluid through check valve 810 keeping a small differential pressure (pressure of the upper chamber less the pressure of the lower chamber), favoring the upper chamber during the filling process. The range of differential pressures will vary depending upon the product utilized. For any product, at the lower end of the range, there must be some positive difference between the pressure of the upper chamber and the pressure of the lower chamber. The upper end of the range is very dependent upon the type of product utilized, with the understanding that the pressure differential must not be so great as to cause any of the product to leak around fins 300. Generally, higher viscosity products can withstand higher differential pressures that lower viscosity products. This upper value is easily determined for any given product by trial and error.

The choice of the setting for the differential pressure will depend not only on the viscosity of the composition being pressure filled through the valve, but also on the quality of the seal that the piston forms with the container. Pressurizing the lower chamber energizes the preferred dual seals in the pistons, thereby preventing the product composition from traveling around the dual seals into the lower chamber.

Finally, the container is then "reverse vacuum" treated in another machine to remove any air trapped on the inside top of the container, preventing "spitting" or "sputtering" of the container when first actuated. At this point, the container filling process is complete.

Products

Products of the present invention generally include a container precursor having a body 102 with piston 200 positioned therein, also include container 100, and include product containing container 100.

Pressurized containers of the present invention are believed to be suitable for dispensing a wide variety of generally any viscosity with little or no leaking of product past fin 300. Generally prior art containers will have difficulty with lower viscosity materials. The present invention may be utilized with materials having viscosities on the low end approaching 0 centipoise and on the high end exceeding 100,000 centipoise.

Generally, the pressurized containers of the present invention may be utilized to dispense products having viscosities on the lower end of the range of generally 10,000 centipoise, preferably about 1,000 centipoise, more preferably about 500 centipoise, even more preferably about 275 centipoise, and still more preferably about 10 centipoise.

Generally, the pressurized containers of the present invention may be utilized to dispense products having viscosities on the upper end of the range of generally greater than 100,000 centipoise, preferably about 100,000 centipoise, more preferably about 75,000 centipoise, even more preferably about 50,000 centipoise, still more preferably about 10,000 centipoise, yet more preferably about 5,000 centipoise, and even still more preferably about 1,000 centipoise.

Non-limiting examples of products which might be residing in upper product containing chamber 131 include oil-in-water emulsions, water-in-oil emulsions, polymeric gels, foams, surfactant mixtures, dispersions, colloidal dispersions, suspensions, polymer solutions, polymer melts, detergents, laundry and cleaning products, adhesives, lubricating oils and greases, paints, chemicals, any type of flowable food product, such as condiments, mayonnaise, ketchup, mustard, sauces, pastes, syrup, cheeses, spreads, jams, jellies, butter/margarine, oil sprays, and the like, and any type of health, beauty and personal care products such as cosmetics, lotions, creams, gels, sprays, mousses, shampoos and conditioners, wound care and the like.

Any suitable propellant as are well known in the are may be utilized, non-limiting examples of which include isobutane, n-butane, propane, dimethyloxide, fluorocarbons, compressed air, nitrogen, and carbon dioxide.

EXAMPLE

The following example is provided merely to illustrate a few of the embodiments of the present invention, and is not meant to, and does not limit the scope of the claims.

Experimental Equipment

The test apparatus consists of 7 main parts. The base is a 4"×4"×1" (L×W×D) block of steel a rod 5.5" long extending upwards from each of the four corners. A 2" internal diameter×2.5" external diameter×0.25" deep circle is cut into the base with the center of the circle at the center of the base. A large rubber gasket, used to seal the ends of the test cylinder, fits into the circular groove. A small hole in the center of the circle runs through the inside of the base and out a section of metal pipe. At the open end of the metal pipe an adapter allows the apparatus to be connected to a compressed air system, which supplies the pressure below the piston in the experiment. The pressure in the apparatus is controlled by an adjoining regulator, which is fitted with a locking switch to ensure the pressure is the same throughout the experiment. A valve in the metal pipe between the steel base and the regulator allows the pressure tubing to be connected to the apparatus without pressurization in the cylinder. This valve also allows the cylinder to remain pressurized after the pressure tubing is disconnected. A pressure gauge mounted on the metal pipe at the base measures the pressure in the cylinder throughout the experiment.

The top of the apparatus is a second steel block of the same dimensions as the base. An identical circle is cut into the underside of the top section and fitted with an identical rubber gasket. Four holes at the corners of the block receive the above described rods extending upward from the base, with a screw in each rod securing the block to the rods. A hole in the center of the block can be fitted with a valve, which is subsequently bolted down to the top of the block. An actuator can be used to operate the valve and release the contents of the pressurized cylinder. A 2" internal diameter× 2.4375" external diameter×5.4375" long clear plastic cylinder is used as the test chamber. This chamber fits between the two steel blocks that make up the base and the top of the apparatus. When bolted securely in place the cylinder is airtight. The piston to be tested fits into the cylinder before the top of the apparatus is bolted down.

Instrumentation:

The following instrumentation was utilized: Brookfield Viscometer Model LVF with Helipath Stand Model D and Helipath Stand Spindle for LV Series Viscometer; an A&D Model HF-6100 Balance; and an American Stirrer Model LR-41D with 2" stirrer blade Piston Description Test Piston No. 1: is the embodiment of the piston of the invention that was tested is that shown in FIGS. 1-6, and this Test Piston No. 1 produces three chambers inside the cylinder. This piston was injection molded from low density polyethylene. The upper chamber can be filled with test solution. The lower chamber can be pressurized. The third chamber, between two plastic sealing fins, acts as a deposit for leaked solution.

Test Piston No. 2: As a control, Test Piston No. 1 was tested against a commercially available piston, commonly used in aerosol shaving cream/gel cans.

Sample Preparation

Samples for this example covered the viscosity range from about 11.86 to about 70,000 centipoise. For solutions in the range 250-2,500 centipoise, a 2% polyacrylic acid polymer in de-ionized water was diluted with additional de-ionized water to the desired viscosity. Solutions with viscosities above 2,500 centipoise were prepared by neutralizing the 2% polyacrylic acid solution with triethanolamine.

Filling Process

In this example the cylinder was fitted with the piston to be tested. The cylinder and piston were placed on the base and the piston was pushed to the bottom of the cylinder. 140 ml of test solution was then poured into the cylinder above the piston. The top of the apparatus was bolted in place. The apparatus was then connected to a pressure hose on the compressed air system. The regulator was set to the desired pressure and the valve was opened pressurizing the cylinder. When the desired pressure in the cylinder was obtained the valve was turned off and the pressure tubing disconnected. The apparatus was allowed to sit undisturbed for the amount of time required in the test (generally a first 30 minute period, and then subsequent observation periods if desired).

Results

Test Piston No. 2, the control, failed at all viscosities below about 10,000 centipoise and less.

The results for Test Piston No. 1 are provided in the following Table 1.

TABLE 1

Results for Test Piston No. 1

| Test Solution | Comments on Leakage |
|---|---|
| 0–11.86 centipoise | The volume of de-ionized water leaked into the lower chamber was less then 10 milliliters after 30-minutes. When the apparatus was agitated as described above the amount of leaked water increased to approximately 15–20 milliliters of water and continued to leak as the apparatus was agitated. For low viscosity fluids, a slight modification of the piston seal, by making them more rigid and longer for greater sealing force and a tighter seal, will be necessary, which modification is envisioned in this invention. A piston so modified is expected to eliminate any leak of low viscosity fluid. |
| 274.56 centipoise | Less than 10 milliliters of test solution leaked past the two seals into the lower chamber during the 30-minute observation period. The apparatus was allowed to sit undisturbed for an additional 30 minutes. By the end of the combined 60-minute period 10 milliliters had leaked past piston. For low viscosity fluids, a slight modification of the piston seal, by making them more rigid and longer for greater sealing force and a tighter seal, will be necessary, which modification is envisioned in this invention. A piston so modified is expected to eliminate any leak of low viscosity fluid. |
| 519.48 centipoise | During the 30-minute observation period less than 5 milliliters of test solution leaked into the lower chamber. No more leakage was observed in the next 30-minute observation period. There appeared to be very little leakage after the cylinder was pressurized. |
| 1021.80 centipoise | At no time during the filling process or the two consecutive 30-minute observation periods was there any leakage past the second seal into the lower chamber. |
| 61,932 centipoise | At no time during the filling process or the two consecutive 30-minute observation periods was there any leakage past the second seal into the lower chamber. |
| 70,590 centipoise | At no time during the filling process or the two consecutive 30-minute observation periods was there any leakage past the second seal into the lower chamber. |

Observations

There was leakage seen in all pistons during the filling process when tested with low viscosity solutions. This leakage was observed and recorded, but because it occurred during the filing process before the piston was activated by pressure, it was not considered a failure of the piston, but rather a problem with the filling method. It is believed that the differential pressure filling method proposed above would eliminate this type of leakage. The two main chambers would be simultaneously filled, with such a filling process activating the piston causing the fins to press against the side of the can as the product solution is added.

Test Piston No. 1 was completely effective down to 500 centipoise. Test Piston No. 2 (the control) was completely effective only down to about 10,000 centipoise. There was no observed limit to any of Test Pistons Nos. 1 or 2 at the high end of the viscosity range above 10,000 centipoise.

The viscosity of de-ionized water was used as the basis for comparison in this example. Test Piston No. 1 was effective at preventing water leakage if the apparatus sat undisturbed. The amount of water leaked over a 30-minute period of undisturbed rest was less than 10 milliliters. Once the apparatus was agitated, by moving it around, turning it upside down or mildly shaking it, both seals did leak water into the lower main compartment. Total leakage below Test Piston No. 1 was not observed at any time during the analysis. Test Piston No. 2 (control) leaked the entire amount of water into the lower chamber and floated at the top of the water.

The cylinder pressure in the experiment was between 58 and 62 pounds per square inch. Approximately 140 milliliters of test solution was used in each trial, which depending upon the density of each solution was between 130 and 160 grams of test solution.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

All patents, articles and other references cited herein, are hereby incorporated by reference for all that they disclose and teach.

I claim:

1. A method of filling a container, the container comprising a hollow cylindrical body with a top end and a bottom end, defining a reservoir, a bottom wall sealing the bottom end, and a valved cap sealing the top end, and a piston positioned within the reservoir, dividing the reservoir into an upper product containing chamber, and a lower propellant containing chamber, wherein the piston comprises a body and at least one fin circumferentially positioned around the body, wherein the fin is of uniform thickness, the method comprising:

(A) providing propellant to the lower chamber at a propellant fill rate; and (B) providing product to the upper chamber;

wherein steps (A) and (B) are carried out simultaneously.

2. The method of claim 1, wherein the piston comprises at least two fins circumferentially positioned around the body, wherein the fins are of uniform thickness.

3. The method of claim 1 further comprising:

(C) monitoring the pressure of the upper chamber and the lower pressure;

(D) adjusting at least one of the propellant fill rate or product fill rate; and, (E) repeating steps (C) and (D).

4. A method of filling a container, the container comprising a hollow cylindrical body with a top end and a bottom end, defining a reservoir, a bottom wall sealing the bottom end, and a valved cap sealing the top end, and a piston positioned within the reservoir, dividing the reservoir into an upper product containing chamber, and a lower propellant containing chamber, wherein the piston comprises a body and at least one fin circumferentially positioned around the body, and wherein the thickness of the fin decreases radially away from the body, the method comprising:

(A) providing propellant to the lower chamber at a propellant fill rate; and (B) providing product to the upper chamber;

wherein steps (A) and (B) are carried out simultaneously.

5. The method of claim 4, wherein the piston comprises at least two fins circumferentially positioned around the body, and wherein the thickness of the fins decreases radially away from the body.

6. A method of filling a container, the container comprising a hollow cylindrical body with a top end and a bottom end, defining a reservoir, a bottom wall sealing the bottom end, and a valved cap sealing the top end, and a piston positioned within the reservoir, dividing the reservoir into an upper product containing chamber, and a lower propellant containing chamber, wherein the piston comprises a body and at least one fin circumferentially positioned around the body, and wherein the thickness of the fin varies circumferentially around the fin, the method comprising:

(A) providing propellant to the lower chamber at a propellant fill rate; and (B) providing product to the upper chamber at a product fill rate;

wherein steps (A) and (B) are carried out simultaneously.

7. The method of claim 6, wherein the piston comprises at least two fins circumferentially positioned around the body, and wherein the thickness of the fin varies circumferentially around the fin.

8. The method of claim 6, further comprising:

(C) monitoring the pressure of the upper chamber and the lower pressure;

(D) adjusting at least one of the propellant fill rate or product fill rate; and, (E) repeating steps (C) and (D).

9. A method of filling a container, the container comprising a hollow cylindrical body with a top end and a bottom end, defining a reservoir, a bottom wall sealing the bottom end, and a valved cap sealing the top end, and a piston positioned within the reservoir, dividing the reservoir into an upper product containing chamber, and a lower propellant containing chamber, wherein the piston comprises a body and at least one fin circumferentially positioned around the body, wherein when the fin is in a first unactivated position, it does not radially extend to the hollow cylindrical body, and when the fin is in a second activated position, it radially extends to and contacts the hollow cylindrical body, the method comprising:

(A) providing propellant to the lower chamber at a propellant fill rate; and (B) providing product to the upper chamber at a product fill rate.

10. The method of claim 9, wherein the piston comprises at least two fins circumferentially positioned around the body, wherein when the fins are in a first unactivated position, the fins do not radially extend to the hollow cylindrical body, and when the fins are in a second activated position, the fins radially extend to and contact the hollow cylindrical body.

11. The method of claim 10, wherein steps (A) and (B) are carried out simultaneously.

12. The method of claim 11, further comprising:

(C) monitoring the pressure of the upper chamber and the lower pressure;

(D) adjusting at least one of the propellant fill rate or product fill rate; and, (E) repeating steps (C) and (D).

13. A method of filling a container, the container comprising a hollow cylindrical body with a top end and a bottom end, defining a reservoir, a bottom wall sealing the bottom end, and a valved cap sealing the top end, and a piston positioned within the reservoir, dividing the reservoir into an upper product containing chamber, and a lower propellant containing chamber, the method comprising:

(A) simultaneously providing propellant to the lower chamber at a first fill rate, while providing product to the upper chamber at a second fill rate.

14. The method of claim 13, further comprising:

(B) monitoring the pressure of the lower chamber and the upper chamber; and (C) varying the first and second fill rates to maintain the pressure of the lower chamber and the pressure of the second chamber within a desired differential pressure range.

* * * * *